US009771940B2

(12) United States Patent
Tsubokawa

(10) Patent No.: US 9,771,940 B2
(45) Date of Patent: Sep. 26, 2017

(54) VACUUM PUMP

(71) Applicant: SHIMADZU CORPORATION, Kyoto (JP)

(72) Inventor: Tetsuya Tsubokawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 323 days.

(21) Appl. No.: 14/559,475

(22) Filed: Dec. 3, 2014

(65) Prior Publication Data

US 2015/0184666 A1 Jul. 2, 2015

(30) Foreign Application Priority Data

Dec. 27, 2013 (JP) ..... 2013-272207
Mar. 5, 2014 (JP) ..... 2014-042494

(51) Int. Cl.
*F04D 19/04* (2006.01)
*F04D 29/08* (2006.01)

(52) U.S. Cl.
CPC ..... *F04D 19/044* (2013.01); *F04D 19/046* (2013.01); *F04D 29/083* (2013.01)

(58) Field of Classification Search
CPC ..... F04D 29/056; F04D 19/04; F04D 19/042; F04D 29/102; F04D 29/646; Y10T 29/49245
See application file for complete search history.

(56) References Cited

U.S. PATENT DOCUMENTS 6,779,969 B2 * 8/2004 Nonaka ..... F04D 19/046 415/143
8,066,495 B2 * 11/2011 Sekiguchi ..... F04D 19/04 417/324

FOREIGN PATENT DOCUMENTS

JP 5-6195 1/1993
JP 2001-003890 A 1/2001
JP 5420323 11/2013

OTHER PUBLICATIONS

Chinese Office Action dated Nov. 3, 2016 for corresponding Chinese Application No. 201410787893.9.

* cited by examiner

*Primary Examiner* — Igor Kershteyn
(74) *Attorney, Agent, or Firm* — Renner Otto Boisselle & Sklar, LLP

(57) ABSTRACT

A vacuum pump comprises: a pump; a pump stator; a base having an exhaust-side space into which the gas discharged by the pump rotor and the pump stator flows and an exhaust port in communication with the exhaust-side space; and a groove pumping element that is provided in a ring shape around a rotational axis of the pump rotor on a downstream end face of the pump rotor or on an inner bottom of the base opposite to the downstream end face and discharges gas from an inner peripheral side of the pump rotor to the exhaust-side space, the groove pumping element being circumferentially provided with alternating grooves defining a concave portion and convex portions, and the groove pumping element being located outside an exhaust path through which gas flows into the exhaust-side space and is thereafter discharged to the exhaust port.

5 Claims, 7 Drawing Sheets

VACUUM PUMP

BACKGROUND OF THE INVENTION

1. Field of the Invention

The present invention relates to a vacuum pump.

2. Description of the Related Art

A vacuum pump represented by a turbo-molecular pump is attached to a vacuum chamber of a dry etching apparatus, a CVD apparatus, etc. The turbo-molecular pump includes a rotor having rotor blades and a rotor cylinder, stator blades opposed to the rotor blades, and a screw stator radially opposed to the rotor cylinder. The rotor rotates at a high speed of tens of thousands of revolutions per minute. The revolution of the rotor causes the rotor blades and the stator blades to cooperate and the rotor cylinder and the screw stator to cooperate to discharge gas in the vacuum chamber and create a high vacuum in the vacuum chamber.

Most of the gas discharged by the rotor cylinder and the screw stator is directed to an exhaust port, while part of the gas may be directed to an inner peripheral side of the rotor. The gas discharged from the vacuum chamber contains corrosive process gas, and this process gas enters a housing (hereinafter referred to as a "motor housing") provided on the inner peripheral side of the rotor and corrodes electrical systems such as a magnetic bearing device and a motor. In order to prevent this problem, an outer peripheral surface of the motor housing can be provided with a thread groove pumping element.

However, various reaction products, which are included in the gas discharged by the rotor cylinder and the screw stator, may be deposited in the thread groove pumping element provided on the outer peripheral surface of the above motor housing. Since the rotor is expanded by centrifugal force during pump operation, a gap between the rotor cylinder and the motor housing is larger during the pump operation than when stopped. Thus, when reaction products are deposited during the pump operation and then a pump is stopped and the expansion of the rotor is restored, an inner peripheral surface of the rotor cylinder and the outer peripheral surface of the motor housing may adhere by the reaction products.

JP H05-006195 Y discloses a device that prevents gas discharged by a rotor cylinder and a screw stator from being directed to an inner peripheral side of a rotor by thread grooves formed integrally with a bottom of a base in a position opposite to the rotor cylinder on the bottom of the base.

The device disclosed in JP H05-006195 Y, however, is provided with a thread groove pumping element in an exhaust path and this may results in degradation of exhaust performance.

SUMMARY OF THE INVENTION

A vacuum pump of the present invention comprises: a pump rotor to be rotated; a pump stator that cooperates with the pump rotor to discharge gas; a base having an exhaust-side space into which the gas discharged by the pump rotor and the pump stator flows and an exhaust port in communication with the exhaust-side space; and a groove pumping element that is provided in a ring shape around a rotational axis of the pump rotor on a downstream end face of the pump rotor or on an inner bottom of the base opposite to the downstream end face and discharges gas from an inner peripheral side of the pump rotor to the exhaust-side space, the groove pumping element being circumferentially provided with alternating grooves defining a concave portion and convex portions, and the groove pumping element being located outside an exhaust path through which gas flows into the exhaust-side space and is thereafter discharged to the exhaust port.

Preferably the pump rotor comprises a plurality of rows of rotor blades and a rotor cylinder provided downstream of the rotor blades, the pump stator comprises a plurality of rows of stator blades arranged alternately with the plurality of rows of rotor blades and a stator provided so as to surround the outer periphery of the rotor cylinder with a predetermined gap, and the groove pumping element is provided on the downstream end face of the rotor cylinder or an area opposite to the downstream end face of the rotor cylinder in the inner bottom of the base.

Preferably a ring-shaped member forming the groove pumping element is provided as a separate member and is fixed on the downstream end face of the rotor cylinder or on the opposite area.

Preferably the groove pumping element is provided on the inner bottom of the base opposite to the downstream end face, an outer diameter of the groove pumping element is substantially equal to an outer diameter of the rotor cylinder during normal rotation of the pump rotor, and an inner diameter of the groove pumping element is substantially equal to or smaller than an inner diameter of the rotor cylinder during normal rotation of the pump rotor.

Preferably an annular groove is provided on the outer peripheral side of the opposite area in the inner bottom of the base.

Preferably an outer diameter of the groove pumping element is equal to or small than an outer diameter of the rotor cylinder and is greater than an inner diameter of the rotor cylinder during normal rotation of the pump rotor.

Preferably an outer end of the groove of the groove pumping element is located on a rotational direction side of the pump rotor with respect to a line extending from the center of the groove pumping element, and an inner end of the groove of the groove pumping element is located opposite to the rotational direction of the pump rotor with respect to the line extending from the center of the groove pumping element.

The present invention provides a vacuum pump which prevents a thread groove pumping element from adhering to a rotor and the exhaust performance of which is not degraded by the thread groove pumping element.

DETAILED DESCRIPTION OF THE EXEMPLARY EMBODIMENTS

For description of a vacuum pump of the present invention, a turbo-molecular pump having a turbo pump section and a drag pump section as a vacuum exhaust unit is described as an example.

Embodiment

Figure 1:
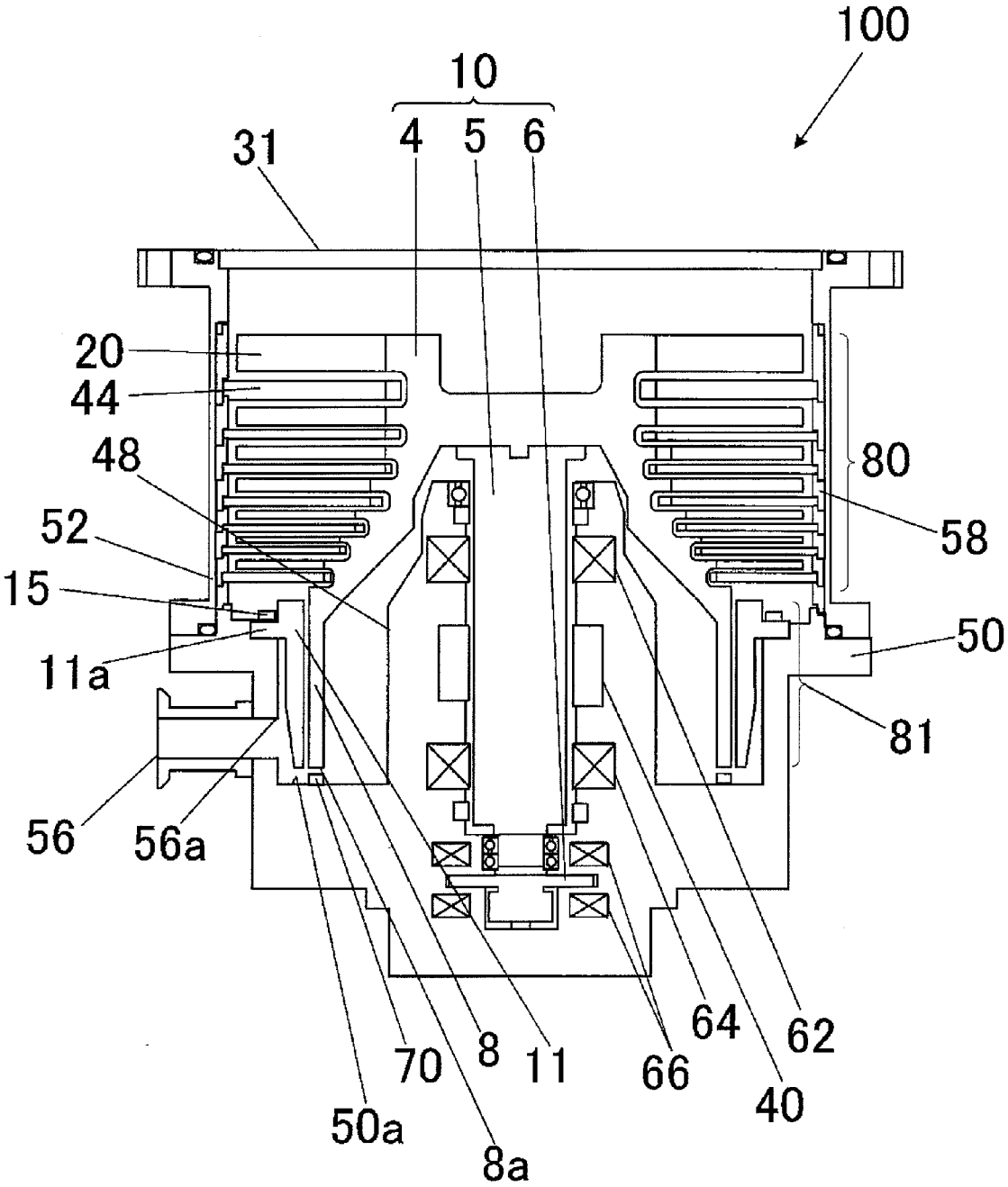
FIG. 1 is a cross-sectional view of a turbo-molecular pump.

FIG. 1 is a cross-sectional view illustrating a schematic configuration of a turbo-molecular pump 100. The turbo-molecular pump 100 includes a turbo pump section 80 and a drag pump section 81 located in a vacuum exhaust downstream side of the turbo pump section 80 as a vacuum exhaust unit. A rotor assembly 10 is rotatably mounted in a casing 52 of the turbo-molecular pump 100. The rotor assembly 10 includes a pump rotor 4, a shaft 5, and a rotor disk 6. The turbo-molecular pump 100 is a magnetic bearing type pump, and the rotor assembly 10 is supported contactlessly by an upper radial electromagnet 62, a lower radial electromagnet 64, and a thrust electromagnet 66.

A motor housing 48 is erected on a base 50. The motor housing 48 includes therein the shaft 5, the upper radial electromagnet 62, the lower radial electromagnet 64, and a motor 40 described below.

The pump rotor 4, being bell-shaped, is placed so as to enclose the motor housing 48. The pump rotor 4 includes a plurality of rows of rotor blades 20 and a rotor cylinder 8. Stator blades 44 are provided between each of the plurality of rows of rotor blades 20, and the rotor blades 20 and the stator blades 44 constitute the turbo pump section 80. An outer peripheral side of the rotor cylinder 8 is provided with a screw stator 11 and these members constitute the drag pump section 81. The screw stator 11 is made of an aluminum alloy, for example. The screw stator 11 is fixed to the base 50 at a flange 11*a* by bolts 15. An inner peripheral surface of the screw stator 11 is provided with a thread groove, while an outer peripheral surface of the rotor cylinder 8 is provided with no thread groove.

The stator blades 44 are disposed on the base 50 via respective spacers 58. When the casing 52 is secured to the base 50, the stacked spacers 58 are held between the base 50 and the casing 52 and the stator blades 44 are positioned.

The base 50 is provided with an exhaust port 56. The exhaust port 56 and its opening 56*a* of this embodiment are provided on a suction port 31 side relative to an inner bottom 50*a* of the base 50. The opening 56*a* of the exhaust port 56, which is open to the vacuum exhaust unit, i.e., which faces the inside of the pump, is located on the outer peripheral side of the rotor cylinder 8. A back pump (not shown) is connected to the exhaust port 56. The rotor assembly 10 is rotated at a high speed by the motor 40 while being magnetically levitated by the upper radial electromagnet 62, the lower radial electromagnet 64, and the thrust electromagnet 66. Thus, gas sucked through the suction port 31 is transferred to an exhaust-side pumping space by discharge operation of cooperating rotor blades 20 and stator blades 44, i.e., the turbo pump section 80, and by discharge operation of cooperating rotor cylinder 8 and screw stator 11, i.e., the drag pump section 81. The gas transferred to the exhaust-side pumping space is discharged by the back pump (not shown) connected to the exhaust port 56 in communication with the exhaust-side pumping space. The exhaust-side pumping space will be described in detail with reference to FIG. 5A.

Figure 2A:
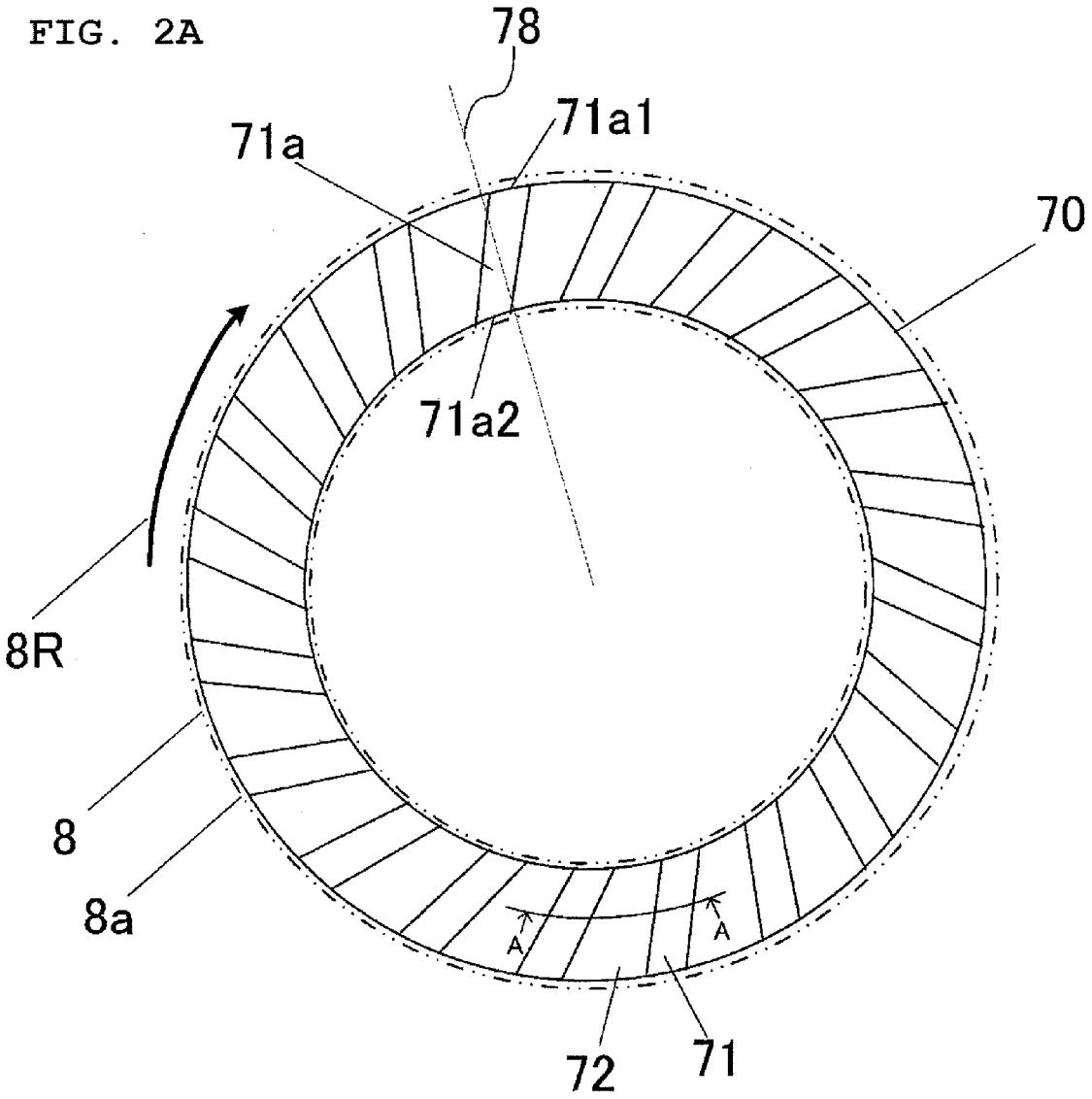
FIGS. 2A and 2B illustrate a thread groove pumping element.
Figure 2B:
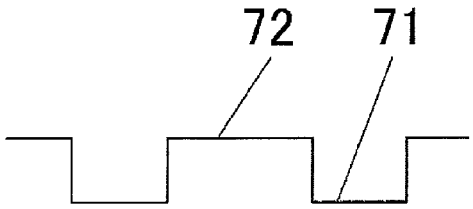

The inner bottom 50*a* of the base 50 is provided with a ring-shaped thread groove pumping element 70 (see FIG. 2A), which is positioned opposite to a "rotational-axis-direction vacuum-exhaust downstream-end-face" (hereinafter referred to just as a "downstream end face") 8*a* of the rotor cylinder 8 during normal rotation and is fixed by screws (not shown) such that the center of the thread groove pumping element 70 matches with the center of the rotational axis of the pump rotor 4. The ring-shaped thread groove pumping element 70 is correspond to "groove pumping element" of the present invention. Here, the structure and operation of the thread groove pumping element 70 will be described with reference to FIGS. 2A and 2B. FIG. 2A illustrates the thread groove pumping element 70 seen from the suction port 31 side. FIG. 2A also illustrates the rotor cylinder 8 in phantom. An arrow designated by the reference numeral 8R indicates the rotational direction of the rotor cylinder 8. Note that although an outer peripheral contour of the rotor cylinder 8 is opposite to that of the thread groove pumping element and an inner peripheral contour of the rotor cylinder 8 is opposite to that of the thread groove pumping element, those contours are shown shifted in the figure for clarity. The thread groove pumping element 70 is provided with a plurality of thread grooves 71. Convex portions 72 are provided associated with the thread grooves 71. FIG. 2B is an A-A cross-sectional view of FIG. 2A. Alternating thread grooves 71 defining a concave portion and convex portions 72 are arranged circumferentially as shown in FIG. 2B. The inclination of a thread groove 71*a*, i.e., one of the thread grooves 71, is described based on a half line 78 extending from the center of the thread groove pumping element. The inclination of other thread grooves 71 is similar to the thread groove 71*a*. An outer end 71*a*1 of the thread groove 71*a* is located on a rotational direction 8R side of the rotor cylinder 8 with respect to the half line 78. On the other hand, an inner end 71*a*2 of the thread groove 71*a* is located opposite to the rotational direction 8R of the rotor cylinder 8 with respect to the half line 78. The thread groove 71*a* is a concave portion connecting the outer end 71*a*1 and the inner end 71*a*2. While both ends 71*a*1 and 71*a*2 are connected straight in the figure, they can be connected in a curved line. The downstream end face 8*a* of the rotor cylinder 8 rotates above the thread grooves 71 in a clockwise direction when viewed from the suction port side, i.e., in the rotational direction 8R, thereby discharging gas to the outer peripheral side of the pump rotor 4. This prevents the gas from being directed to the inner peripheral side of the pump rotor 4. Such a discharge mechanism is referred to as a "Siegbahn pump mechanism".

Referring back to FIG. 1, the thread groove pumping element 70 is provided on the inner bottom 50*a* of the base 50. The rotor cylinder 8 is expanded mainly in the radial direction by centrifugal force while the rotor cylinder 8 is rotated. This expansion, however, is not likely to affect the rotational axis direction. That is, the dimension in the rotational axis direction of the rotor cylinder 8 changes little between the time at which the rotor cylinder 8 is rotated and the time at which it is stopped. Thus, a gap between the downstream end face 8*a* of the rotor cylinder 8 and the thread groove pumping element 70 changes little between the time at which the rotor cylinder 8 is rotated and the time at which it is stopped. As such, the pump rotor 4 (rotor cylinder 8) during stopping would not adhere to the thread groove pumping element 70 if reaction products are deposited on the thread groove pumping element 70.

Figure 5A:
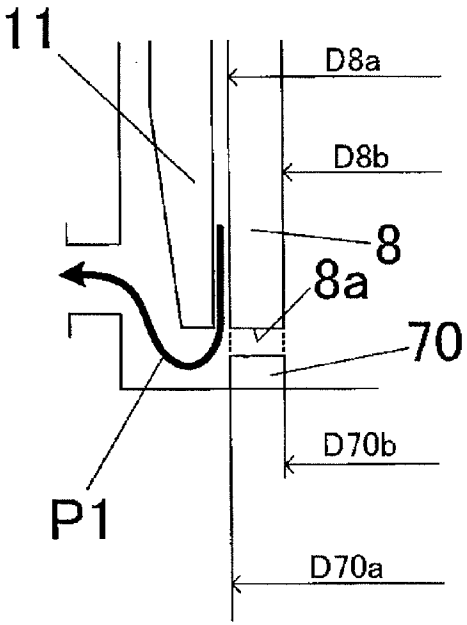
FIGS. 5A to 5C illustrate modifications of the thread groove pumping element.

Referring further to FIG. 5A, FIG. 5A shows the position of the thread groove pumping element 70 of this embodiment with respect to the rotor cylinder 8 during normal rotation of the pump rotor 4. The left side of FIG. 5A is the outer peripheral side. As shown in FIG. 5A, an outer diameter D70*a* of the thread groove pumping element 70 is substantially equal to an outer diameter D8*a* of the rotor cylinder 8 during normal rotation.

When the thread groove pumping element 70 is provided as described above, the thread groove pumping element 70 is not located on the outer peripheral side of the rotor cylinder 8 during normal rotation. As mentioned above, the opening 56*a* of the exhaust port 56, which faces the inside of the pump, is provided on the outer peripheral side of the rotor cylinder 8.

Thus, the thread groove pumping element 70 is not located in the exhaust-side pumping space, i.e., a space through which gas discharged by the cooperating rotor cylinder 8 and the screw stator 11 reaches the exhaust port 56. The thread groove pumping element 70 is therefore not located in an exhaust path P1 through which the gas discharged by the cooperating rotor cylinder 8 and the screw stator 11 flows into the exhaust-side pumping space and is thereafter discharged to the exhaust port 56. Consequently, the thread groove pumping element 70 does not degrade the exhaust performance of the turbo-molecular pump 100.

Additionally, an inner diameter D70*b* of the thread groove pumping element 70 is equal to an inner diameter D8*b* of the rotor cylinder 8 during normal rotation. That is, the downstream end face 8*a* of the rotor cylinder 8 during normal rotation and the thread groove pumping element 70 are opposed to each other. This enables the exhaust performance of the Siegbahn pump mechanism, which is configured by the thread groove pumping element 70 and the downstream end face 8*a* of the rotor cylinder 8, to be maximized.

According to the above embodiment, the following effects can be obtained:

(1) The turbo-molecular pump 100 of the present invention includes the base 50 on which the motor housing 48 having the motor 40 is erected, the bell-shaped pump rotor 4 that is placed so as to enclose the motor housing 48 and is rotated by the motor 40, and the stator blades 44 and the screw stator 11 as a pump stator that cooperates with the pump rotor 4 to discharge gas. The base 50 has the exhaust-side pumping space into which the gas discharged by the pump rotor 4 and the pump stator (i.e., the stator blades 44 and the screw stator 11) flows and the exhaust port 56 in communication with the exhaust-side pumping space. The turbo-molecular pump 100 further includes the thread groove pumping element 70, which is provided in a ring shape around the rotational axis on the inner bottom 50*a* of the base opposite to the downstream end face 8*a* of the rotor cylinder 8, i.e., the "rotational-axis-direction vacuum-exhaust downstream-end-face" of the bell-shaped pump rotor 4, and has the thread grooves 71 for discharging gas from a region where the motor housing 48 is provided to the exhaust-side pumping space. The thread groove pumping element 70 is located outside the exhaust path P1 through which the gas discharged by the rotor cylinder 8 and the screw stator 11 flows into the exhaust-side pumping space and is thereafter discharged to the exhaust port 56.

The thread groove pumping element 70 is not an impediment to exhaust flow accordingly and does not degrade the exhaust performance of the turbo-molecular pump 100.

(2) The thread groove pumping element 70 is provided on the inner bottom 50*a* of the base 50 at a position opposite to the downstream end face 8*a* of the rotor cylinder 8 during normal rotation. The rotor cylinder 8 rotates just above the upper surface of the thread grooves 71 of the thread groove pumping element 70 so that the discharge mechanism functions to discharge gas of the motor housing 48 side to the outer peripheral side.

Thus, gas discharged by the rotor cylinder 8 and the screw stator 11, containing corrosive process gas, can be prevented from being directed to the inner peripheral side of the pump rotor 4 (rotor cylinder 8). Consequently, it is possible to prevent corrosion of the motor 40, magnetic bearings, etc. in the motor housing 48 provided on the inner peripheral side of the pump rotor 4.

(3) The thread groove pumping element 70 is provided on the inner bottom 50*a* of the base 50. The rotor cylinder 8 is expanded mainly in the radial direction by centrifugal force while the rotor cylinder 8 is rotated. This expansion, however, is not likely to affect the rotational axis direction. That is, the dimension in the rotational axis direction of the rotor cylinder 8 changes little between the time at which the rotor cylinder 8 is rotated and the time at which it is stopped. Thus, the gap between the downstream end face 8*a* of the rotor cylinder 8 and the thread groove pumping element 70 changes little between the time at which the rotor cylinder 8 is rotated and the time at which it is stopped.

Accordingly, the pump rotor 4 (rotor cylinder 8) during stopping would not adhere to the thread groove pumping element 70 if reaction products are deposited on the thread groove pumping element 70.

Thus, the turbo-molecular pump 100 can be restarted without a case where the pump rotor 4 cannot rotate.

(4) The opening 56*a* of the exhaust port 56, which is open to the vacuum exhaust unit, is provided on the outer peripheral side of the rotor cylinder 8. Additionally, the outer diameter D70*a* of the thread groove pumping element 70 is preferably equal to the outer diameter D8*a* of the rotor cylinder 8 during normal rotation of the pump rotor 4. That is, the thread groove pumping element 70 is not located on the outer peripheral side of the rotor cylinder 8 during normal rotation.

Thus, the thread groove pumping element 70 is located outside the exhaust path through which gas discharged by the cooperating rotor cylinder 8 and the screw stator 11 reaches the exhaust port 56 so that the thread groove pumping element 70 does not degrade the exhaust performance of the turbo-molecular pump 100.

Figure 6A:
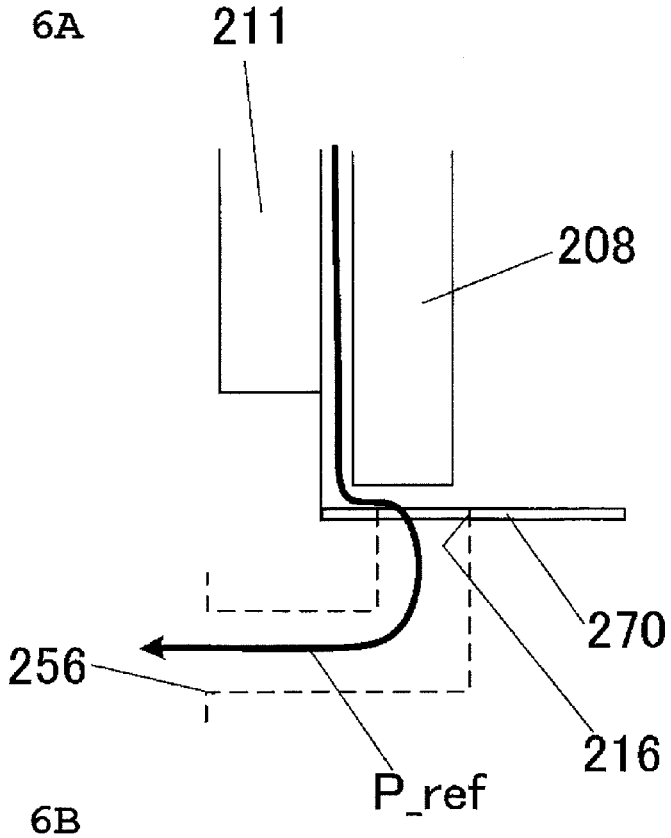
FIGS. 6A and 6B illustrate a device described in JP H05-006195 Y.
Figure 6B:
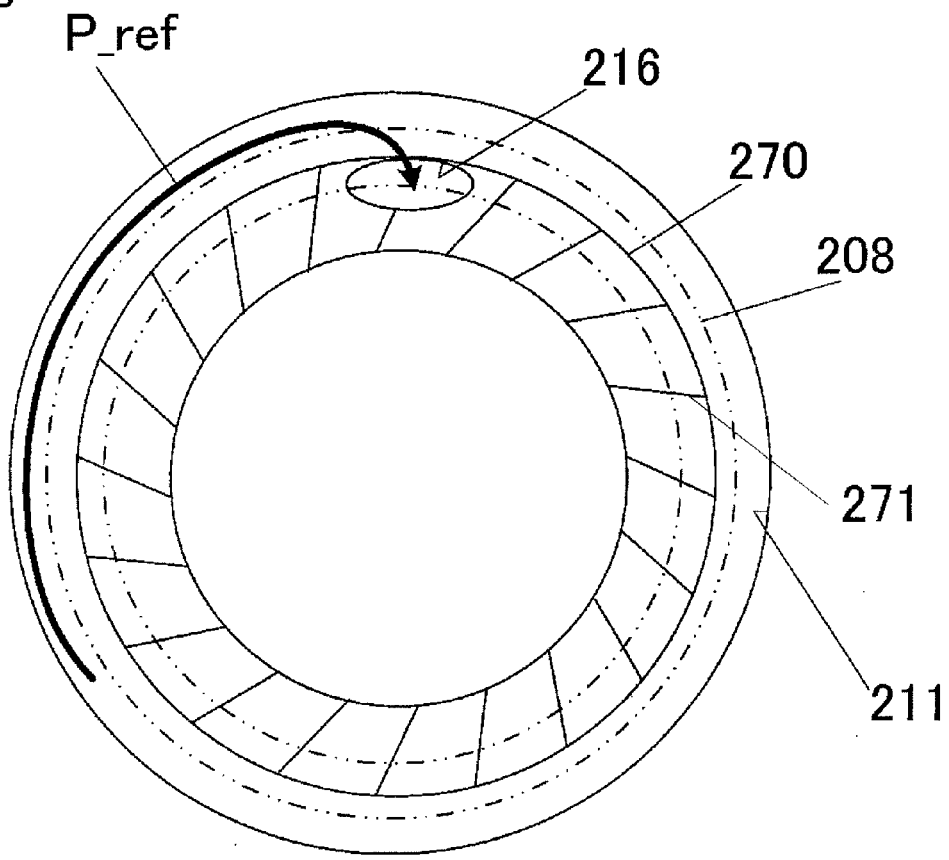

The present invention is compared with the device of JP H05-006195 Y shown in FIG. 6. FIGS. 6A and 6B correspond to FIGS. 2 and 3 of JP H05-006195 Y, respectively. A path designated by the reference character P_ref indicates an exhaust path of gas.

In the device of JP H05-006195 Y, a thread groove pumping element 270 (corresponding to an auxiliary thread groove 18 of JP H05-006195 Y) is provided with a through-hole 216 (corresponding to an exhaust passage 16 of JP H05-006195 Y). This reduces a region to form a thread groove 271, potentially degrading the exhaust performance of the thread groove pumping element 270.

On the other hand, the thread groove pumping element 70 provided in the turbo-molecular pump 100 of the present invention has no element such as the through-hole 216 that interferes with the formation of the thread grooves 71. That is, the thread groove pumping element 70 of the present invention is provided continuously over the entire circumference with alternating thread grooves 71 and convex portions 72.

Furthermore, in the device of JP H05-006195 Y, gas discharged by a stator 211 and a rotor 208 need to pass through the through-hole 216 provided in the thread groove pumping element 270 in order to reach an exhaust port 256.

The rotor 208 (corresponding to the rotor 4 of JP H05-006195 Y) rotates in close proximity to the through-hole 216 and cooperates with the thread groove pumping element 270 to discharge gas to the outer peripheral side. That is, a discharge mechanism for discharging gas to the outer peripheral side works in close proximity to the through-hole 216 and this may interfere with the passage of the gas through the through-hole 216. While the outer peripheral side of the through-hole 216 is provided with no thread groove 271, the thread groove 271 provided on the inner peripheral side apparently discharges the gas to the outer peripheral side and this may interfere with the passage of the gas through the through-hole 216. In order to make the discharge mechanism work, the thread grooves 271 and the rotor 208 need to be close to each other. A decrease in conductance around the through-hole 216 also may be considered accordingly.

On the other hand, the thread groove pumping element 70 provided in the turbo-molecular pump 100 of the present invention is located outside the exhaust path through which gas discharged by the cooperating rotor cylinder 8 and the screw stator 11 flows into the exhaust-side pumping space and is thereafter discharged to the exhaust port 56. Consequently, the discharge mechanism for discharging the gas to the outer peripheral side is not an impediment to exhaust flow, and closeness between the rotor cylinder 8 and the thread groove pumping element 70 also does not decrease the conductance of the exhaust path.

(5) The outer diameter D70*a* of the thread groove pumping element 70 is preferably equal to the outer diameter D8*a* of the rotor cylinder 8 during normal rotation of the pump rotor 4, and the inner diameter D70*b* of the thread groove pumping element 70 is preferably equal to the inner diameter D8*b* of the rotor cylinder 8 during normal rotation. That is, the downstream end face 8*a* of the rotor cylinder 8 during normal rotation and the thread groove pumping element 70 are preferably opposed to each other.

This enables the exhaust performance of the Siegbahn pump mechanism, which is configured by the thread groove pumping element 70 and the rotor cylinder 8, to be maximized.

(6) The ring-shaped thread groove pumping element 70 is fixed on the inner bottom 50*a* of the base 50 by screws. In other words, the thread groove pumping element 70 is separate from the base 50.

This facilitates machining of the thread groove as described below.

Since the inner bottom 50*a* of the base 50 is located in the inner region of the base 50, it is difficult to integrally form the thread groove on the inner bottom 50*a* of the base 50.

In this embodiment, the thread grooves 71 are formed on the thread groove pumping element 70 separate from the base 50 so that the thread grooves are easily formed by machining as compared to integrally forming thread grooves on the base 50.

The following modifications are also within the scope of the present invention, and one or more of the modifications may be combined with the embodiment described above. Descriptions similar to those of the above embodiment are not given.

First Modification

Figure 3:
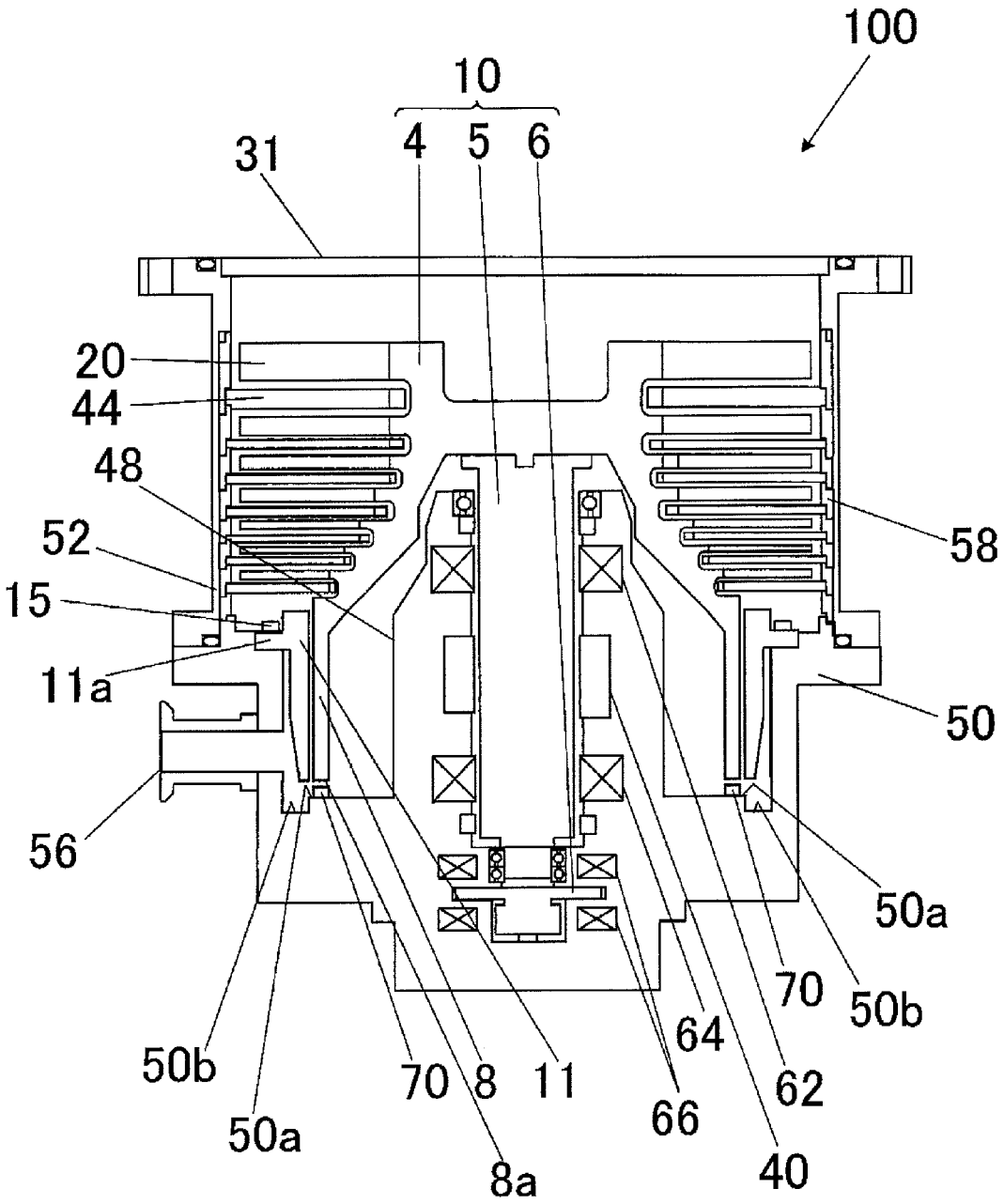
FIG. 3 illustrates a modification of an inner bottom of a base.

A modification of the inner bottom 50*a* of the base 50 will be described with reference to FIG. 3. In this modification, an annular groove 50*b* is formed in a part of the inner bottom 50*a* of the base 50, which part is located on the outer peripheral side of the rotor cylinder 8. That is, the annular groove 50*b* is formed on the outer peripheral side relative to the opposing area of the rotor cylinder 8 and the inner bottom 50*a* of the base 50 in the inner bottom 50*a* of the base 50. Providing the annular groove 50*b* allows expansion of the exhaust path through which gas discharged by the cooperating rotor cylinder 8 and the screw stator 11 reaches the exhaust port 56. This improves the conductance and the exhaust performance of the turbo-molecular pump 100.

Second Modification

Figure 4:
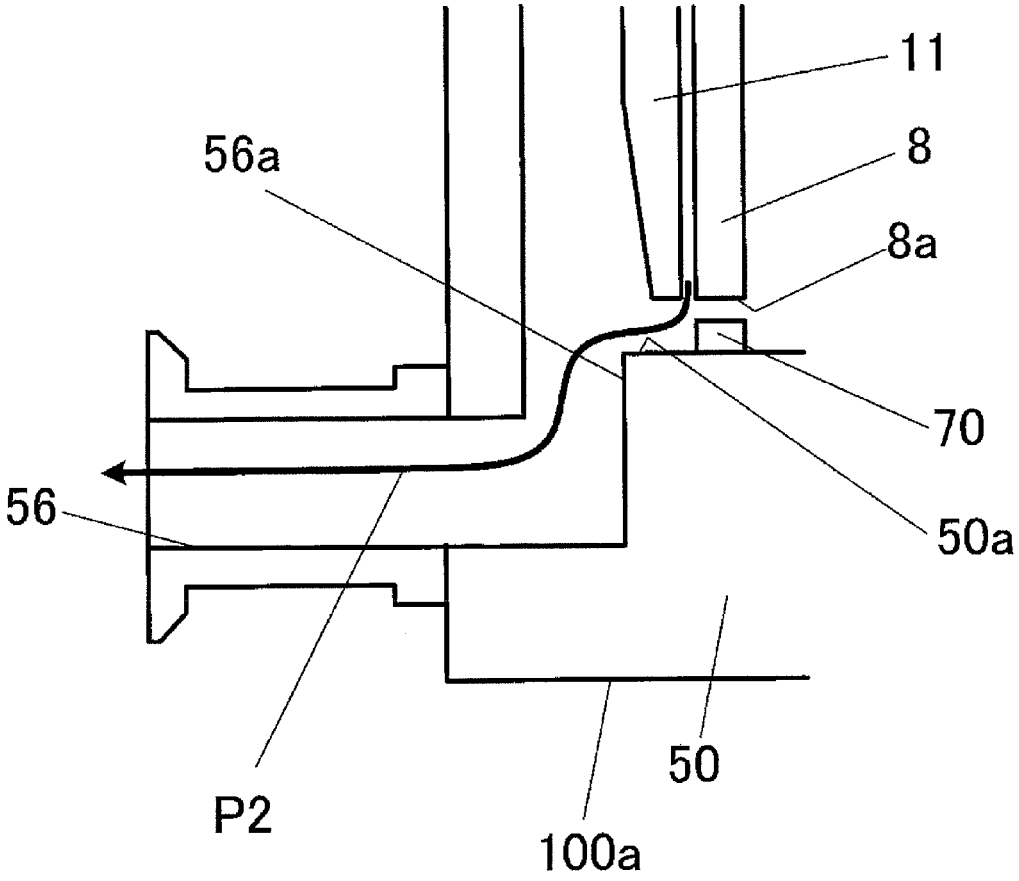
FIG. 4 illustrates a modification of the position of an exhaust port.

A modification of the position of the exhaust port 56 will be described with reference to FIG. 4. While the exhaust port 56 is provided on the suction port 31 side of the inner bottom 50*a* of the base 50 in the embodiment described above, the exhaust port 56 is provided on the lower surface 100*a* side (lower side in the figure) of the pump relative to the inner bottom 50*a* of the base 50 in this modification. However, like the above embodiment, the opening 56*a* of the exhaust port 56, which faces the inside of the pump, is provided on the outer peripheral side of the rotor cylinder 8. As with the embodiment, the thread groove pumping element 70 is not located on the outer peripheral side of the rotor cylinder 8 during normal rotation.

Thus, the thread groove pumping element 70 is not located in an exhaust path P2 through which gas discharged by the cooperating rotor cylinder 8 and the screw stator 11 reaches the exhaust port 56, and the thread groove pumping element 70 does not degrade the exhaust performance.

This modification also has the effects similar to the above embodiment accordingly.

Figure 5B:
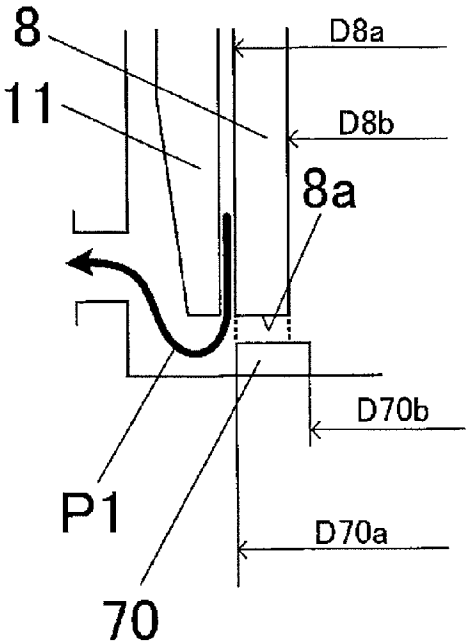
Figure 5C:
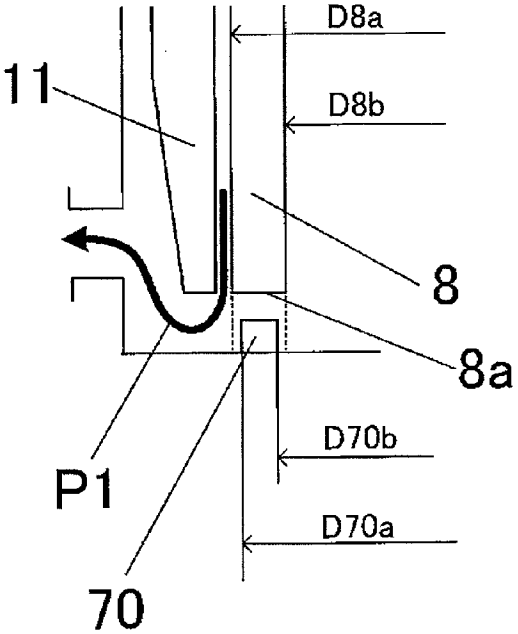

A third modification and a fourth modification set forth below are modifications of the thread groove pumping element 70. Thread groove pumping elements 70 of the third and fourth modifications will be described as compared with the thread groove pumping element 70 of the above embodiment with reference to FIGS. 5B and 5C. The left side of FIGS. 5B and 5C is the outer peripheral side. FIGS. 5B and 5C illustrate a state during normal rotation of the pump rotor 4 (rotor cylinder 8).

Third Modification

An outer diameter D70*a* of the thread groove pumping element 70 of this modification shown in FIG. 5B is equal to the outer diameter D70*a* of the thread groove pumping element 70 shown in FIG. 5A. This means that the outer peripheral end of the thread groove pumping element is not located on the outer peripheral side of the rotor cylinder 8. Thus, the thread groove pumping element 70 is not located in an exhaust path P1 through which gas discharged by the cooperating rotor cylinder 8 and the screw stator 11 reaches the exhaust port 56, and the thread groove pumping element 70 does not degrade the exhaust performance of the turbo-molecular pump 100.

Additionally, an inner diameter D70*b* of the thread groove pumping element 70 of this modification shown in FIG. 5B is smaller than the inner diameter D70*b* of the thread groove pumping element 70 shown in FIG. 5A. An inner peripheral end of the thread groove pumping element 70 is therefore located on the inner peripheral side relative to the inner peripheral end of the downstream end face 8*a* of the rotor cylinder 8 during normal rotation of the pump rotor 4.

Since an area where the rotor cylinder 8 and the thread groove pumping element 70 are not opposed to each other does not have a discharging effect, the exhaust performance of the thread groove pumping element 70 and the rotor cylinder 8 shown in FIG. 5B is equal to that of the thread groove pumping element 70 and the rotor cylinder 8 shown in FIG. 5A.

Fourth Modification

An outer diameter D70*a* of the thread groove pumping element 70 of this modification shown in FIG. 5C is smaller than the outer diameter D70*a* of the thread groove pumping element 70 shown in FIG. 5A. An outer peripheral end of the thread groove pumping element 70 is therefore located on the inner peripheral side relative to the outer peripheral end of the downstream end face 8*a* of the rotor cylinder 8 during normal rotation of the pump rotor 4. This means that the outer peripheral end of the thread groove pumping element 70 is not located on the outer peripheral side of the rotor cylinder 8. Thus, the thread groove pumping element 70 is not located in an exhaust path P1 through which gas discharged by the cooperating rotor cylinder 8 and the screw stator 11 reaches the exhaust port 56, and the thread groove pumping element 70 does not degrade the exhaust performance of the turbo-molecular pump 100.

Additionally, an inner diameter D70*b* of the thread groove pumping element 70 of this embodiment shown in FIG. 5C is greater than the inner diameter D70*b* of the thread groove pumping element 70 shown in FIG. 5A. An inner peripheral end of the thread groove pumping element 70 is therefore located on the outer peripheral side relative to the inner peripheral end of the downstream end face 8*a* of the rotor cylinder 8 during normal rotation of the pump rotor 4.

As seen from the above, the opposing area of the thread groove pumping element 70 and the rotor cylinder 8 shown in FIG. 5C is smaller than that shown in FIG. 5A so that the exhaust performance of the thread groove pumping element 70 and the rotor cylinder 8 shown in FIG. 5C is lower than that of the thread groove pumping element 70 and the rotor cylinder 8 of the previously described embodiment shown in FIG. 5A. However, as long as gas can be prevented from being directed to the inner peripheral side of the pump rotor 4, there is no problem with the thread groove pumping element 70 such as shown in FIG. 5C.

As can be seen from the above-described embodiment and the third and fourth modifications, it should be appreciated that the following conditions (I) and (II) are imposed on the outer diameter D70*a* of the thread groove pumping element 70.

(I) In order to provide an exhaust mechanism for preventing gas from being directed to the inner peripheral side of the pump rotor 4 using the thread groove pumping element 70 and the rotor cylinder 8, the opposing area of the thread groove pumping element 70 and the rotor cylinder 8 is needed. In order to make the thread groove pumping element 70 and the rotor cylinder 8 face each other during normal rotation of the pump rotor 4, the outer diameter D70*a* of the thread groove pumping element 70 is preferably greater than the inner diameter D8*b* of the rotor cylinder 8 during normal rotation of the pump rotor 4.

(II) The opening 56*a* of the exhaust port 56 is open to the outer peripheral side of the rotor cylinder 8. Thus, for the thread groove pumping element 70 to be located outside the exhaust path through which gas discharged by the cooperating rotor cylinder 8 and the screw stator 11 reaches the exhaust port 56 during normal rotation of the pump rotor 4, the outer diameter D70*a* of the thread groove pumping element 70 is preferably smaller than or equal to the outer diameter D8*a* of the rotor cylinder 8 during normal rotation of the pump rotor 4.

Although the thread groove pumping element 70 is provided on the inner bottom 50*a* of the base 50, it may be provided on the downstream end face 8*a* of the rotor cylinder 8, in which case the thread groove pumping element 70 can be integral with or separate from the rotor cylinder 8. When the thread groove pumping element 70 is provided on the "rotational-axis-direction vacuum-exhaust downstream-end-face" of the rotor cylinder 8, it should be appreciated that the following conditions (III) and (IV) are imposed. These conditions (III) and (IV) are assumed a time at which the pump rotor 4 is normally rotated. The reason to assume the normal rotation of the pump rotor 4 in the case where the thread groove pumping element 70 is provided on the downstream end face 8*a* of the rotor cylinder 8 is because of considering the difference in the expansion coefficients of the thread groove pumping element 70 and the rotor cylinder 8.

(III) In order to provide the thread groove pumping element 70 on the "rotational-axis-direction vacuum-exhaust downstream-end-face" of the rotor cylinder 8, the outer diameter D70*a* of the thread groove pumping element 70 is preferably greater than the inner diameter D8*b* of the rotor cylinder 8 and smaller than or equal to the outer diameter D8*a* of the rotor cylinder 8.

(IV) For the thread groove pumping element 70 to be located outside the exhaust path through which gas discharged by the cooperating rotor cylinder 8 and the screw stator 11 reaches the exhaust port 56, the thread groove pumping element 70 need to be prevented from protruding from the outer peripheral end of the downstream end face 8*a* of the rotor cylinder 8. That is, as with the conclusion of (II) described above, the outer diameter D70*a* of the thread groove pumping element 70 is preferably smaller than or equal to the outer diameter D8*a* of the rotor cylinder 8 during normal rotation of the pump rotor 4.

As shown above, whether the thread groove pumping element 70 is provided on the inner bottom 50*a* of the base 50 or on the downstream end face 8*a* of the rotor cylinder 8, the condition that the outer diameter D70*a* of the thread groove pumping element 70 is preferably greater than the inner diameter D8*b* of the rotor cylinder 8 and smaller than or equal to the outer diameter D8*a* of the rotor cylinder 8 during normal rotation of the pump rotor 4 is imposed on the thread groove pumping element 70.

The thread groove pumping element 70 may be provided on both of the inner bottom 50*a* of the base 50 and the downstream end face 8*a* of the rotor cylinder 8.

While the thread groove pumping element 70 is fixed on the inner bottom 50*a* of the base 50 by screws in the embodiment, it may be fixed with an adhesive.

While the thread groove pumping element 70 is separate from the base 50 in the embodiment, it can be integral with the base 50.

Although the present invention is applied to the vacuum pump having a turbo pump section and a drag pump section in the above description, the present invention is also applicable to the following vacuum pumps:

Vacuum pump that has no turbo pump section and has only a drag pump section as a vacuum exhaust unit, i.e., molecular drag pump.

As with the turbo-molecular pump 100 shown in FIG. 1, the molecular drag pump can be provided with a thread groove pumping element. In other words, the thread groove pumping element can be provided on an area opposite to the "rotational-axis-direction vacuum-exhaust downstream-end-face" of a rotor cylinder in the inner bottom of a base.

Vacuum pump that has no drag pump section and has only a turbo pump section as a vacuum exhaust unit, i.e., turbo-molecular pump with a full complement of blades.

Figure 7:
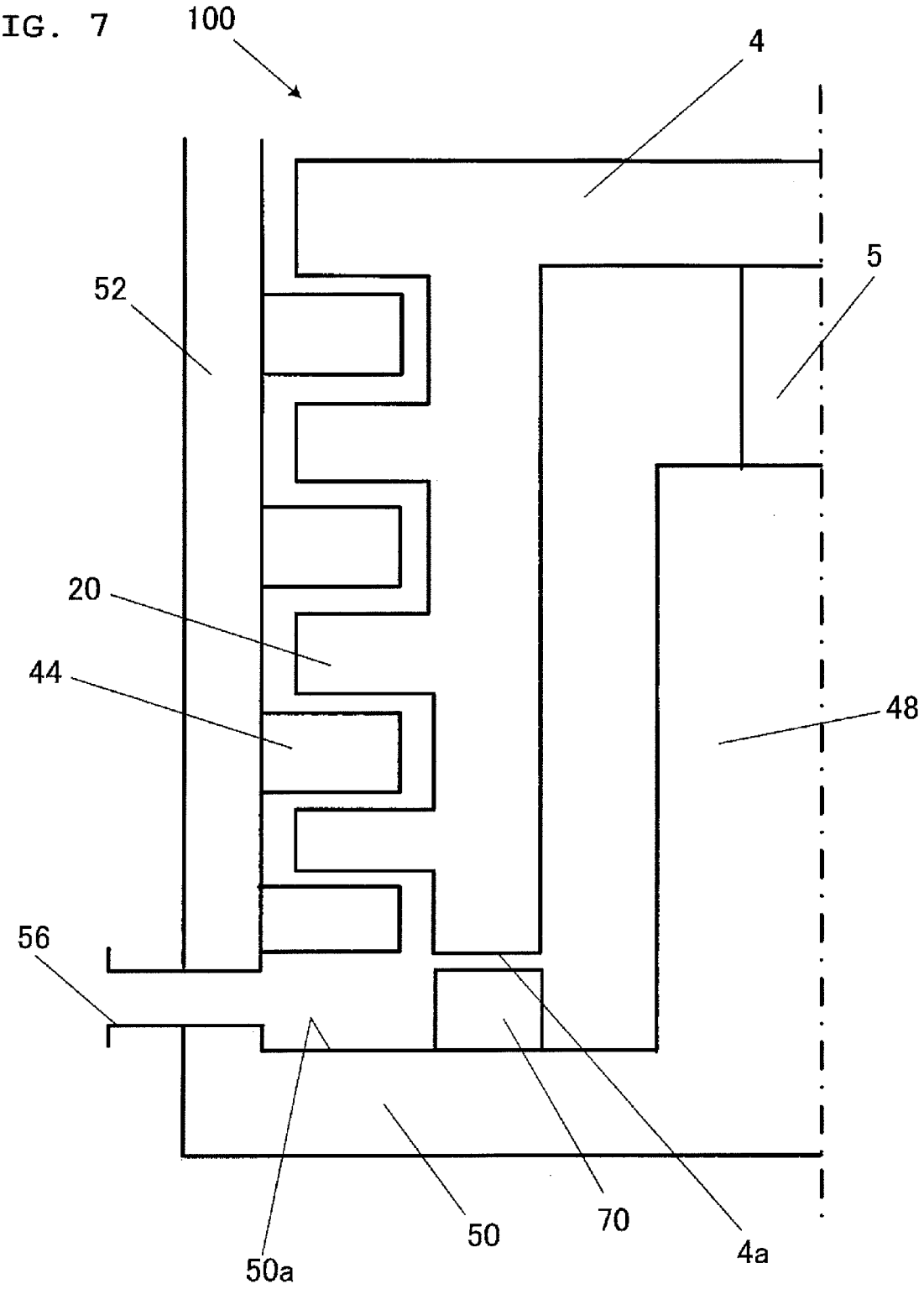
FIG. 7 illustrates a turbo-molecular pump with a full complement of blades.

FIG. 7 illustrates part of a turbo-molecular pump 100 with a full complement of blades. The turbo-molecular pump 100 with a full complement of blades is provided, as a vacuum exhaust unit, with a pump rotor 4 having a plurality of rows of rotor blades 20 and stator blades 44 between each of the plurality of rows of rotor blades 20. The turbo-molecular pump 100 with a full complement of blades can be provided with a thread groove pumping element 70 on an area opposite to the "rotational-axis-direction vacuum-exhaust downstream-end-face" 4*a* of the pump rotor 4 in the inner bottom 50*a* of a base 50.

Although the present invention is applied to the vacuum pump having magnetic bearings for supporting a rotor assembly in the above description, the present invention is also applicable to a vacuum pump having bearings other than the magnetic bearings, i.e., rolling bearings.

The vacuum pump of the present invention may be provided with a thread groove on either the inner peripheral surface of the stator or the outer peripheral surface of the rotor cylinder. Although the stator provided with the thread groove on its inner peripheral surface, i.e., the screw stator, is used in the above description, the thread groove can be provided on the outer peripheral surface of the rotor cylinder instead of providing the thread groove on the inner peripheral surface of the stator.

While the various embodiments and modifications are described above, the present invention is not intended to be limited thereto. Other aspects based on the technical idea of the present invention are also included within the scope of the present invention.

What is claimed is:

1. A vacuum pump comprising:

a pump rotor to be rotated, the pump rotor including a plurality of rows of rotor blades and a rotor cylinder provided downstream of the rotor blades;

a pump stator that cooperates with the pump rotor to discharge gas, the pump stator including a plurality of rows of stator blades arranged alternately with the plurality of rows of rotor blades and a stator provided so as to surround the outer periphery of the rotor cylinder with a predetermined gap;

a base having an exhaust-side space into which the gas discharged by the pump rotor and the pump stator flows and an exhaust port in communication with the exhaust-side space; and a groove pumping element that is provided in a ring shape around a rotational axis of the pump rotor on a downstream end face of the rotor cylinder or on an area opposite to the downstream end face of the rotor cylinder in the inner bottom of the base and discharges gas from an inner peripheral side of the pump rotor to the exhaust-side space, the groove pumping element being in circumferential direction provided with alternating grooves defining a concave portion and convex portions, and the groove pumping element being located outside an exhaust path through which gas flows into the exhaust-side space and is thereafter discharged to the exhaust port, and during normal rotation of the pump rotor, an outer diameter of the groove pumping element being greater than an inner diameter of the rotor cylinder and smaller than or equal to the outer diameter of the rotor cylinder.

2. The vacuum pump according to claim 1, wherein a ring-shaped member forming the groove pumping element is provided as a separate member and is fixed on the downstream end face of the rotor cylinder or on the opposite area.

3. The vacuum pump according to claim 1, wherein the groove pumping element is provided on the inner bottom of the base opposite to the downstream end face, the outer diameter of the groove pumping element is substantially equal to the outer diameter of the rotor cylinder during normal rotation of the pump rotor, and an inner diameter of the groove pumping element is substantially equal to or smaller than the inner diameter of the rotor cylinder during normal rotation of the pump rotor.

4. The vacuum pump according to claim 1, wherein an annular groove is provided on the outer peripheral side of the opposite area in the inner bottom of the base.

5. The vacuum pump according to claim 1, wherein an outer end of the groove of the groove pumping element is located on a rotational direction side of the pump rotor with respect to a line extending from the center of the groove pumping element, and an inner end of the groove of the groove pumping element is located opposite to the rotational direction of the pump rotor with respect to the line extending from the center of the groove pumping element.

* * * * *